US005839400A

United States Patent [19]

Vattaneo et al.

[11] Patent Number: 5,839,400

[45] Date of Patent: Nov. 24, 1998

[54] INTERNAL COMBUSTION ENGINE WITH VARIABLY ACTUATED VALVES

[75] Inventors: Francesco Vattaneo, Pancalieri; Marco Consani, S. Pietro Val Lemina Pinerolo; Lorentino Macor, Beinasco, all of Italy

[73] Assignee: C.R.F. Societa' Consortile per Azioni, Turin, Italy

[21] Appl. No.: 847,361

[22] Filed: Apr. 24, 1997

[30] Foreign Application Priority Data

Apr. 24, 1996 [IT] Italy ..... T096A0327

[51] Int. Cl.[6] ..... F01L 13/00; F01L 9/02

[52] U.S. Cl. ..... 123/90.16; 123/90.12; 123/308; 123/470; 123/568

[58] Field of Search ..... 123/90.11, 90.12, 123/90.13, 90.15, 90.16, 90.17, 90.48, 90.6, 308, 470, 472, 568

[56] References Cited

U.S. PATENT DOCUMENTS

| | | | |
|---|---|---|---|
| 3,683,874 | 8/1972 | Berlyn | 123/90.12 |
| 4,357,917 | 11/1982 | Aoyama | 123/90.16 |
| 4,696,265 | 9/1987 | Nohira | 123/90.12 |
| 4,875,455 | 10/1989 | Hashimoto et al. | 123/315 |
| 4,887,562 | 12/1989 | Wakeman | 123/90.12 |
| 4,945,873 | 8/1990 | Kirchweger et al. | 123/308 |
| 5,050,557 | 9/1991 | Ishida et al. | 123/308 |
| 5,081,971 | 1/1992 | Inoue et al. | 123/308 |
| 5,115,782 | 5/1992 | Klinke et al. | 123/90.11 |
| 5,138,989 | 8/1992 | Fraidl et al. | 123/308 |
| 5,193,494 | 3/1993 | Sono et al. | 123/90.12 |
| 5,373,818 | 12/1994 | Unger | 123/90.16 |

*Primary Examiner*—Wellun Lo

*Attorney, Agent, or Firm*—Sughrue, Mion, Zinn, Macpeak & Seas, PLLC

[57] ABSTRACT

An internal combustion engine has two intake valves for each cylinder which can be uncoupled from the respective tappets by drawing fluid under pressure out of a chamber interposed between each tappet and the respective valve. To each engine cylinder there are associated two intake valves, one of which is actuated only at high speed and high loads of the engine. The engine is deprived of the conventional throttle valve. The two intake conduits associated with each cylinder have different specific shapes.

5 Claims, 7 Drawing Sheets

INTERNAL COMBUSTION ENGINE WITH VARIABLY ACTUATED VALVES

BACKGROUND OF THE INVENTION

The present invention relates to multi-cylinder internal combustion engines, of the type comprising:

at least one intake valve and at least one exhaust valve for each cylinder, each provided with respective spring means for biasing the valve to a closed position, in order to control respective intake and exhaust conduits, a cam shaft for actuating the intake valves of the engine cylinders by means of respective tappets, in which each of said tappets drives the respective intake valve, against the action of said spring means, with the interposition of hydraulic means including a chamber of fluid under pressure, a solenoid valve for communicating said chamber of fluid under pressure to an outlet channel, in order to uncouple the tappet from the respective valve and cause the rapid closing of the latter under the action of the respective biasing spring means, and electronic control means for said solenoid valve in order to vary the opening timing and stroke of the valve as a function of one or more parameters of operation of the engine, such as the rotational speed and the position of the accelerator pedal.

Engines of the above indicated type are known and have been used since a long time in order to optimize the performance of the engine at any running condition. Documents DE-A-3 834 882, DE-A-3 532 549, EP-A-0 317 364 and U.S. Pat. No. 5,193,494 show embodiments of engines of the above indicated type. In these engines, the opening timing and stroke of the intake valves can be varied by controlling the communication of the pressure chamber associated with each valve to said outlet channel so as to uncouple, when necessary, the valve itself by the respective tappet.

However, the solutions proposed heretofore are not fully satisfactory from the standpoint of simplicity and reliability of the construction, and sometimes have set up problems due to poor combustion and/or high amounts of nitrogen oxides in the exhaust gases.

SUMMARY OF THE INVENTION

The object of the present invention is that of overcoming these drawbacks.

In order to achieve this object, the invention provides a multi-cylinder internal combustion engine of the type indicated at the beginning of the present description, characterized by the combination of the following features:

the engine is of the type comprising at least two intake valves for each cylinder, which control respective intake conduits, the engine has a fuel injection feeding system and lacks of a throttle valve arranged upstream of the engine intake manifold, the air flow fed to the engine cylinders being controlled only by the cylinder intake valves, the two intake valves associated with each engine cylinder are provided with two respective solenoid valves for controlling the communication of the respective pressure chambers to said outlet channel, so that the two valves may be actuated in different ways and independently from each other, said electronic control means are able to open a first intake valve of each engine cylinder only above a predetermined engine speed, the second intake valve being the only valve to control the air flow fed to the cylinder below said speed, the two intake conduits associated with each cylinder have specific shapes which are different and such as to favour the mixing of the air flows coming from the two intake conduits within the cylinder combustion chamber.

As it appears, in the engine according to the invention, to each cylinder there are associated two intake valves, one of which is actuated only at high engine speeds, opening the respective conduit, in order to provide adequate filling of the cylinder and obtain maximum engine power, whereas the other valve fulfills the function of adjusting the air flow fed to the cylinder in the various engine running condition. As also indicated above, due to the use of this device, the engine according to the invention may avoid the use of the conventional throttle valve arranged upstream of the intake manifold, with a resulting simplification of construction. The electronic control means of the engine can attend to controlling the operation of the intake valves, by actuating the respective solenoid valves which control the pressure chamber associated with the various intake valves, and taking into account one or more parameters of operation of the engine, such as the position of the accelerator pedal and the engine rotational speed, which are detected, in a way known per se, by respective sensor means connected to the electronic control means.

A problem which is found in the engines of the above specified type is that in these conditions the air mass which enters into the cylinder is lower than that of a conventional engine and is cooled to a greater extent, with respect to the case of a conventional engine, as a result of the reduction of the effective compression ratio. This condition, along with further conditions such as the reduced motion field due to the reduced opening stroke of the intake valve, as well as the difficulty in optimizing the fuel coming out from the injector due to the absence of the vacuum which instead takes place in the conventional engines with a throttle valve, may cause, in the previously proposed solutions, a poor combustion.

In the engine according to the invention, the separate control of the two intake valves enables on one hand only one of the two valves to be used throughout the greater part of the running conditions of the engine, so as to reduce the organic and electric losses of the system to levels lower than those of a conventional engine, and at the same time enables the two intake conduits to be designed in a different way so as to favour the mutual mixing of the two air flows coming out therefrom. In particular, the conduit associated with said second intake valve can be shaped so as to induce a strong tumble within the charge entering into the cylinder, particularly in the conditions in which the opening stroke of the valve is reduced.

A further relevant feature of the invention lies in that the tappet associated with each intake valve is arranged with its axis substantially at 90° with respect to the valve stem, and that to each engine cylinder there is associated a fuel injector arranged within the intake conduit controlled by said second intake valve, adjacent to the outlet thereof.

Said 90° arrangement of the tappet with respect to the valve stem is possible since the pushing action is transmitted by the tappet to the valve by means of the fluid present in the pressure chamber. This 90° arrangement enables the axis of the intake valve to be arranged substantially vertical, even it the axis of the camshaft is much spaced horizontally apart from the cylinder axis. The substantially vertical arrangement of the valve then provides an optimum arrangement of the injector at the conduit controlled by this valve and adjacent to the outlet of this conduit. The best arrangement of the injector is particularly important, with low strokes of the intake valves, since it provides a good atomizing of the fuel within the combustion chamber, although the ambient is not subject to the vacuum which instead takes place in the conventional engines using a throttle valve.

A further important feature of the invention lies in that the actuating cam of said second intake valve associated with each engine cylinder has an auxiliary projection, in order to cause a partial opening of the valve during the cylinder discharge stage, in order to direct part of the residual combustion gases into the intake conduit controlled by said second valve. In this manner, the risk is avoided of having a high percentage of $No_x$ in the exhaust gases of the engine, because of the absence of the vacuum which takes place in the conventional engines having a throttle valve. In these engines, during the overlapping stage of the opening of the intake and exhaust valves, a part of the residual combustion gases is drawn into the intake conduit, because of the difference in pressure which takes place between intake and exhaust. In the engine according to the invention, this pressure differential does not exist, so that, in the absence of any further measure, the amount of residual gases which goes into the intake conduit would be very reduced. In these conditions, for a same mass of air trapped within the cylinder, the total mass (air/fuel+residual gases) would be much lower with respect to the case of a conventional engine with a throttle valve, which would involve that at the end of combustion temperatures much higher with respect to the case of the conventional engine would be reached, with a resulting greater percentage of the $No_x$ in the exhaust gases, since this depends, as it is generally known, from the maximum temperature in the combustion cycle. Due to the above specified feature, said auxiliary projection of the cam controlling the intake valve causes a partial opening of the valve during the cylinder discharge stage, so as to direct part of the residual combustion gases into the intake conduit, under the pushing action generated by the piston during its upward movement towards the top dead centre. Furthermore, by suitably phasing the closing and opening points of the control solenoid valve, the amount of residual gases which remain in the cylinder after the intake stage can be adjusted. In this way, the maximum combustion temperature is reduced and therefore the noxious emissions at the exhaust are reduced.

It is also to be pointed out that the engine according to the invention provides a better mixing of the residual gases, so as to increase the percentage of residual gases which can be introduced into the cylinder without jeopardizing the combustion.

Finally, yet a further important feature of the invention lies in that said tappets associated with the engine intake valves, with the respective hydraulic means for controlling the valves and the respective control solenoid valves, form part of a single pre-assembled sub-assembly fixed to the engine head, which has a body including a conduit which communicates all the outlet channels controlled by the solenoid valves to at least one pressure accumulator, which also forms part of said sub-assembly.

Due to this feature, the assembling operations of the engine according to the invention are particularly simple and rapid, In particular, the whole cylinder head can be pre-assembled, along with said sub-assembly,

BRIEF DESCRIPTION OF THE DRAWINGS

Further features and advantages of the invention will become apparent from the description which follows with reference to the annexed drawings, given purely by way of non-limiting example, in which:

In FIGS. 1, 3, reference numeral 1 generally designates the head of a multi-cylinder internal combustion engine (in the case of the illustrated example, a 5 in-line cylinder engine) comprising, for each cylinder, a cavity 2 formed in the bottom surface 3 of the head 1, defining the combustion chamber, into which there open two intake conduits 4, 5 and two exhaust conduits 6. The communication of the two intake conduits 4, 5 with the combustion chamber 2 is controlled by two intake valves 7, of the mushroom-like conventional type, each comprising a stem 8 slidably mounted within the body of head 1. Each valve 7 is biased towards the closing position by springs 9 interposed between an inner surface of head 1 and an end disk 10 of the valve. The opening of the intake valves 7 is controlled, in the way which will be described in the following, by a cam shaft 11 rotatably mounted around an axis 12 within supports 13 (FIG. 2) of head 1 and comprising a plurality of cams 14 for actuating the valves.

Figure 1:
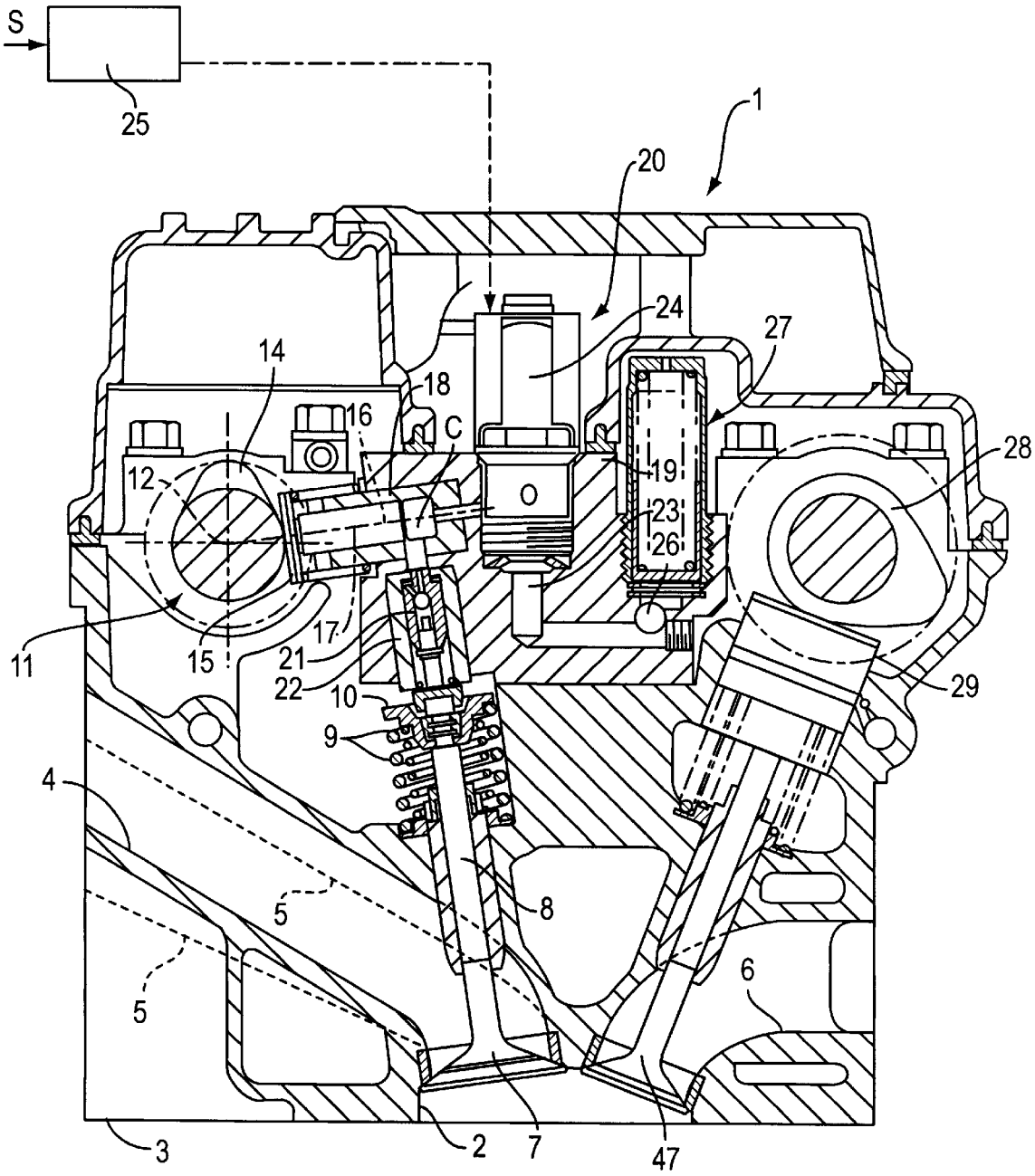
FIG. 1 is a cross-sectional view of the head of an internal combustion engine according to the invention.

Each cam 14 controlling an intake valve 7 cooperates with the plate 15 of a tappet 16 slidably mounted along an axis 17 substantially directed at 90° with respect to the axis of valve 7, within a bush 18 carried by a body 19 of a pre-assembled sub-assembly 20 incorporating all the electric and hydraulic devices involved in the actuation of the intake valves, as described in detail in the following. The tappet 16 is able to transmit a pushing action to the stem 8 of valve 7, so as to cause the opening of the latter, against the action of spring means 9, by means of fluid under pressure present in a chamber C and a piston 21 slidably mounted within a bush 22 also carried by the body 19 of sub-assembly 20. The details of construction of piston 21 are not described and shown herein, since they can be provided in any known way and do not fall, taken alone, within the scope of the present invention. However, preferably, the end of piston 21 has a diametric notch 21*a* (FIG. 8), not provided in the known solutions, which provides a better flow of the oil out of cylinder 22 in the final stage of the return stroke of the valve in the closed position. A tappet arrangement with a chamber of fluid under pressure and a piston controlling the intake valve is for instance described and shown in previous Italian patent application No.- TO94A001061 of 22 Dec. 1994. However, the arrangement illustrated herein, differs from that known from this patent application in that the tappet is arranged with its axis 17 at 90° with respect to the axis of valve 8. Also according to a technique known per se, the chamber of fluid under pressure C associated with each intake valve 7 can be communicated to an outlet channel 23 by means of a solenoid valve 24. According to a technique also known per se, the solenoid valve 24, which can be of any known type suitable for the function illustrated herein, is controlled by electronic control means, diagrammatically designated by 25, as a function of signals S indicative of parameters of operation of the engine, such as the position of the accelerator pedal and the engine rotational speed. When the solenoid valve 24 is opened, chamber C is put in communication with channel 23, so that the fluid under pressure present in chamber C flows into this channel and an uncoupling of the tappet 16 from the respective intake valve 7 is obtained, which valve is then rapidly returned to its closing position, under the action of return springs 9. By controlling the communication between chamber C and the outlet channel 23 it is therefore possible to vary at will the opening timing and stroke of each intake valve 7.

An important feature of the engine according to the invention, lies in that there is provided a solenoid valve 24 for each of the two intake valves 7 associated with each engine cylinder. This enables the two intake valves 7 of each cylinder to be controlled separately, according to modes which will be illustrated hereinafter With reference to FIG. 2, the outlet channels 23 of the various solenoid valves 24 all open into a same longitudinal channel 26 communicating with two pressure accumulators 27 (only one of which is visible in FIGS. 1, 2).

All the tappets 16 with the associated bushes 18, the pistons 21 with the associated bushes 2, the solenoid valves 24 and the respective channels 23, 26 are supported and formed in said body 19 of the pre-assembled sub-assembly 20, to advantage for rapidity and easiness of assembly of the engine according to the invention.

Figure 2:
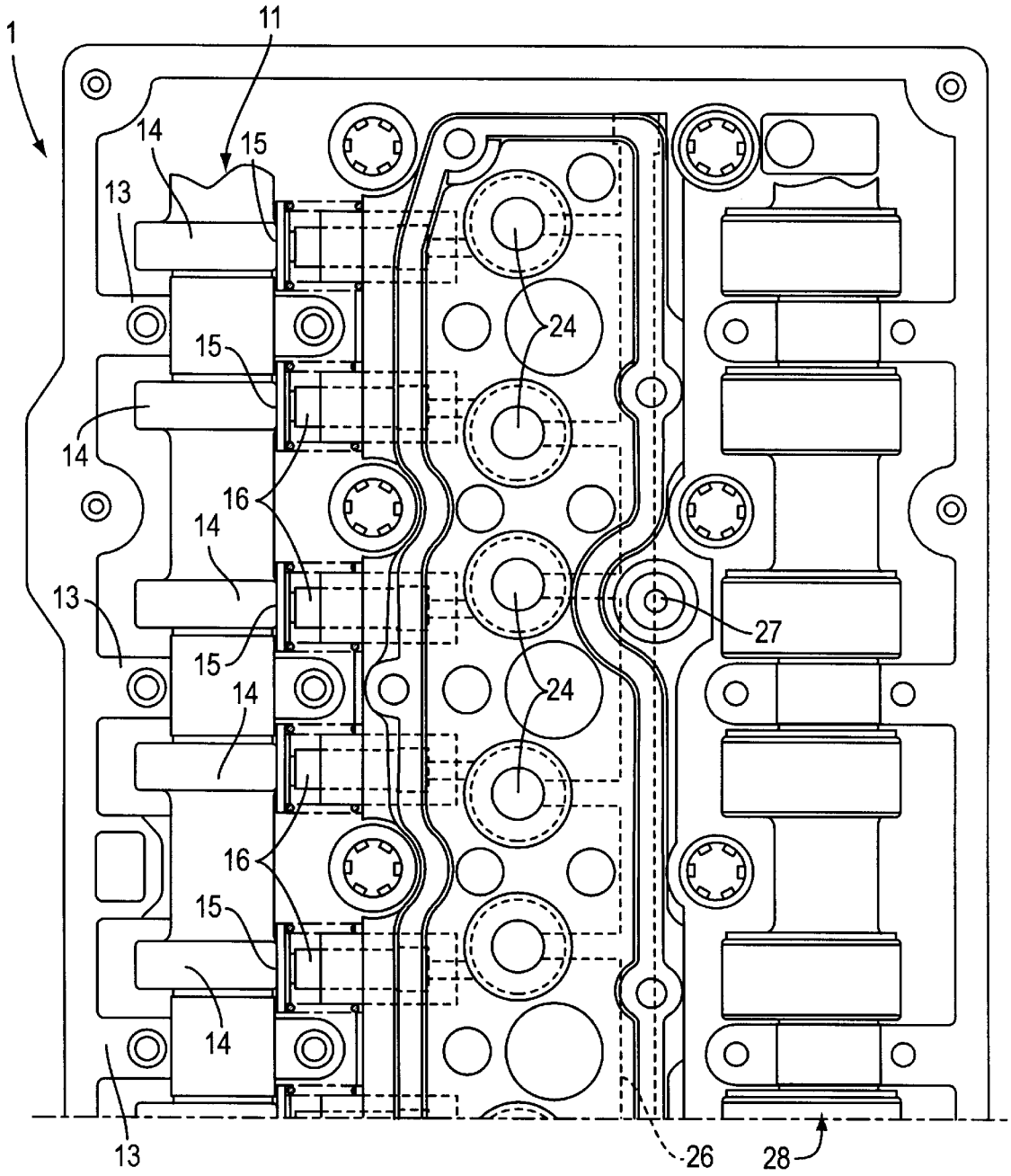
FIG. 2 is a cross-sectional view taken along line II—II of FIG. 1.

Yet with reference to FIG. 1, the discharge valves, designated by reference numeral 47, are controlled in a conventional way by a cam shaft 28 by means of respective tappets 29.

Figure 3:
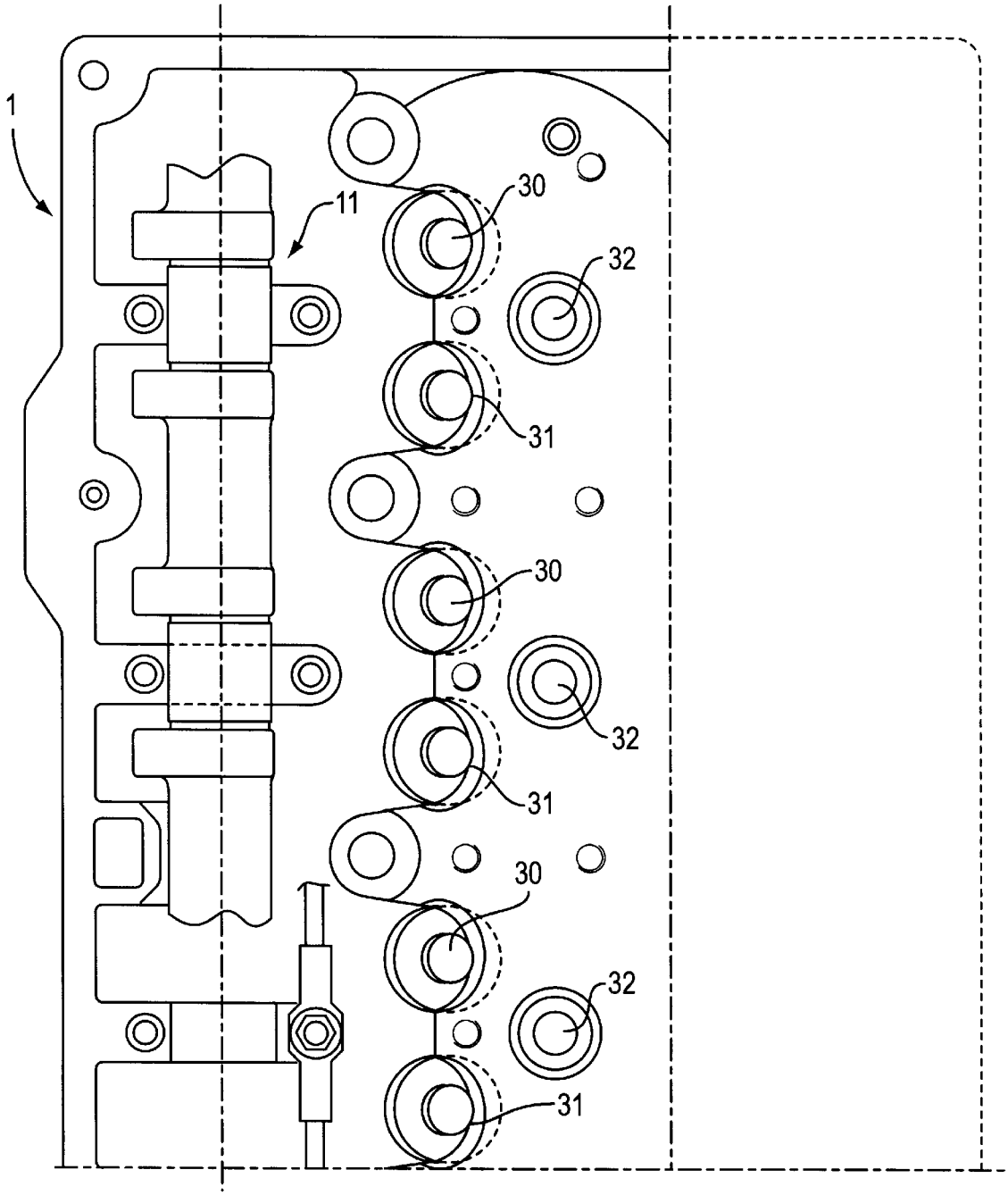
FIG. 3 is a cross-sectional view taken along line III—III of FIG. 1.

In FIG. 3, reference numerals 30, 31 designate the seats of the intake valves 7 associated with each engine cylinder, and reference numerals 32 designate the seats for the spark plugs associated with the various combustion chambers.

Figure 4:
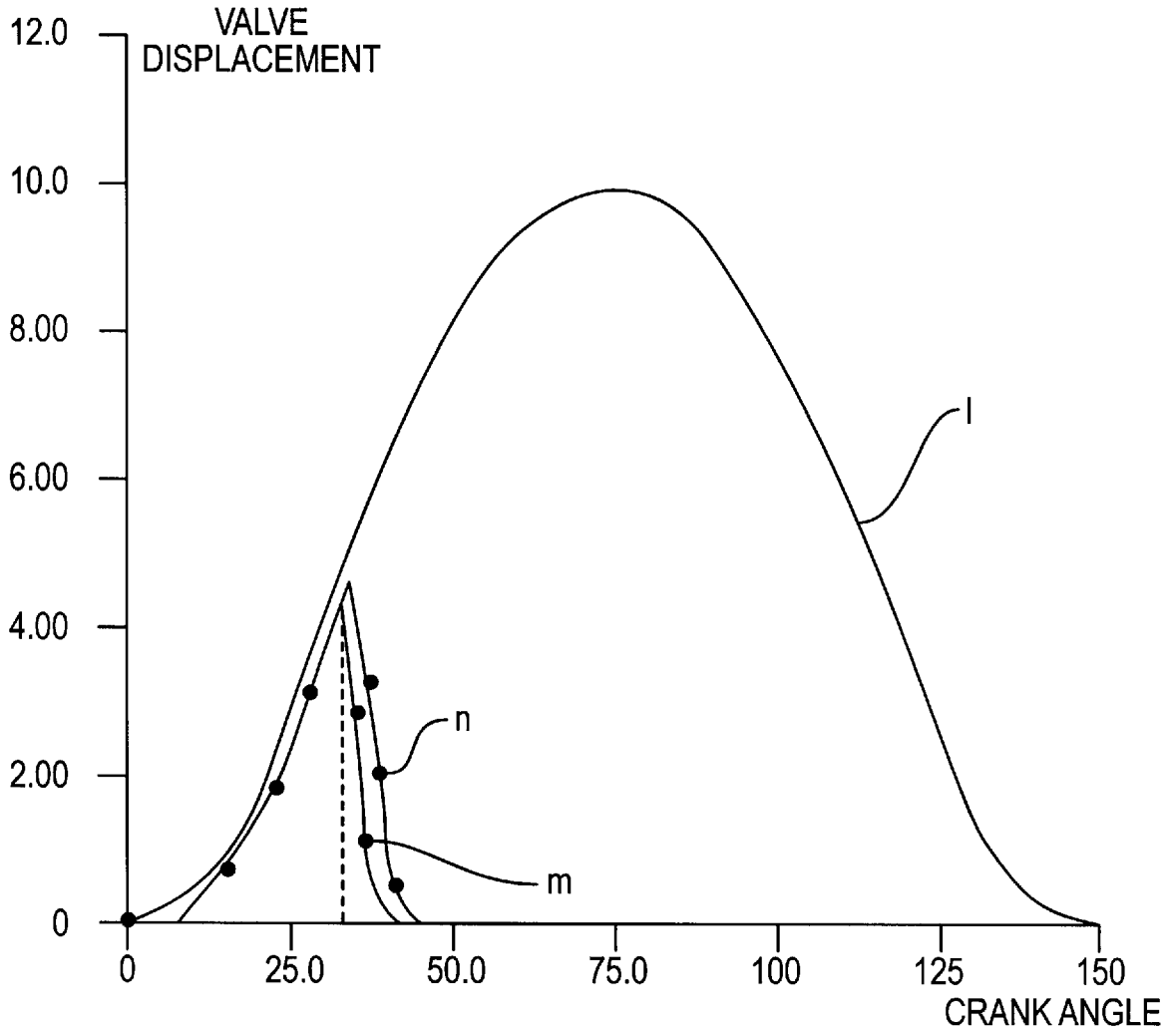
FIG. 4 is an experimental diagram which shows the way of operation of one intake valve of the engine according to the invention, compared with a conventional engine.

FIG. 4 is an experimental diagram which shows the way of controlling the intake valves 7 of the engine according to the invention. When the chamber C of fluid under pressure is constantly kept isolated, each intake valve 7 is controlled by the respective cam 14 in a way similar to a conventional engine. In this case, the opening stroke of the valve as a function of the engine angle is given by the diagram designated by letter l. Letters m and n refer to two diagrams which show the different behaviour of the intake valve of the engine according to the invention, at two low engine speeds, respectively 700 and 500 rpm. In both cases, for an engine angle $\phi_2$=32°, chamber C is communicated to the outlet channel 23, so that the valve is rapidly closed under the action of the respective springs 9.

As clarified in the preamble of the present description, the engine according to the invention is of the type provided with a fuel injection feeding system and is deprived of a throttle valve arranged upstream of the engine intake manifold. Therefore, in the engine according to the invention, the air flow fed to the engine cylinders is controlled only by the intake valves 7 of the cylinders.

As also already clarified above, an important feature of the invention lies in that each intake valve 7 is provided with a respective control solenoid valve 24, so that the two intake conduits 4, 5 associated with each cylinder of the engine may be controlled independently and in different ways.

Figure 5:
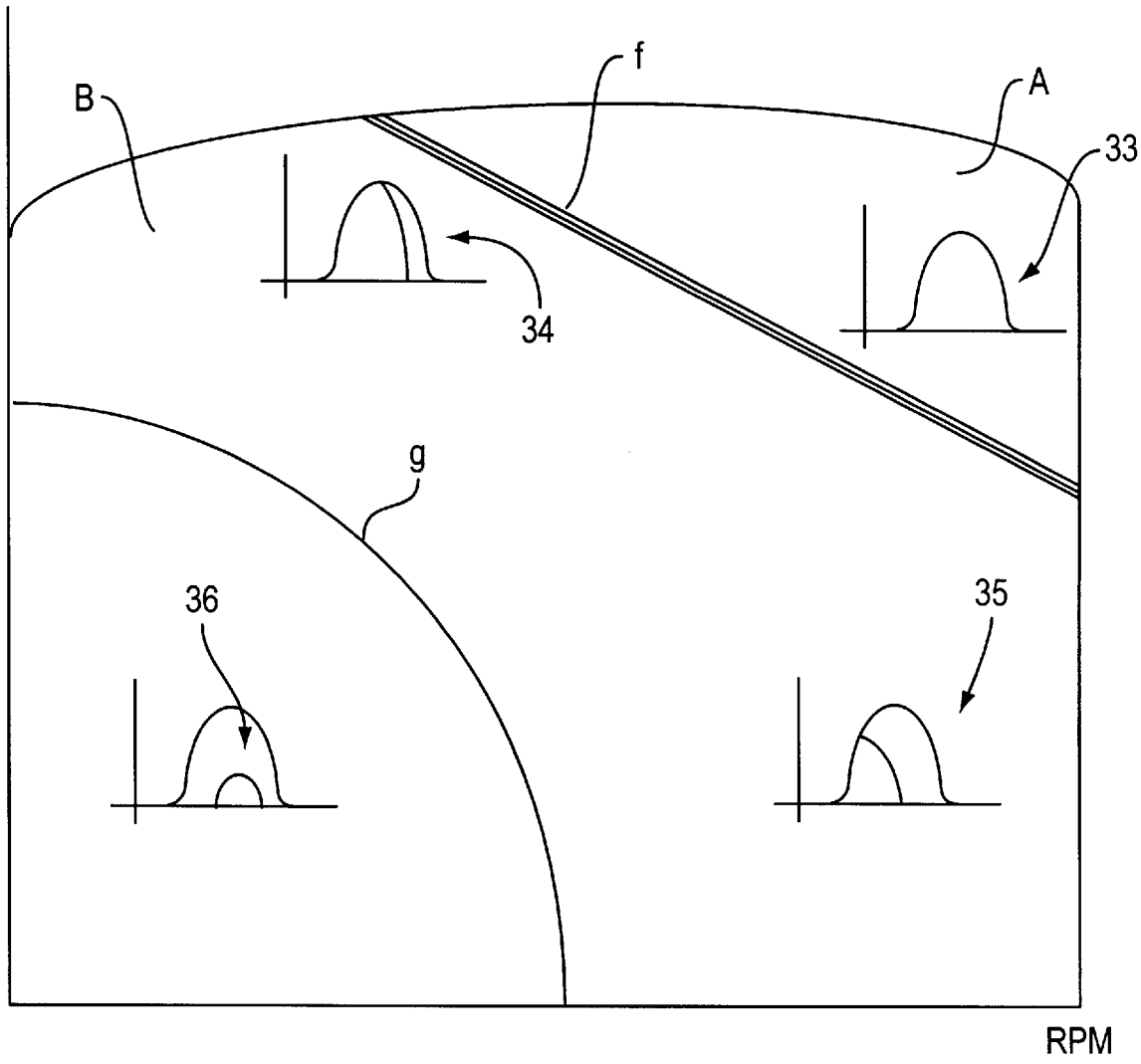
FIG. 5 is a diagram which shows the way of operating of the engine according to the invention.
Figure 6:
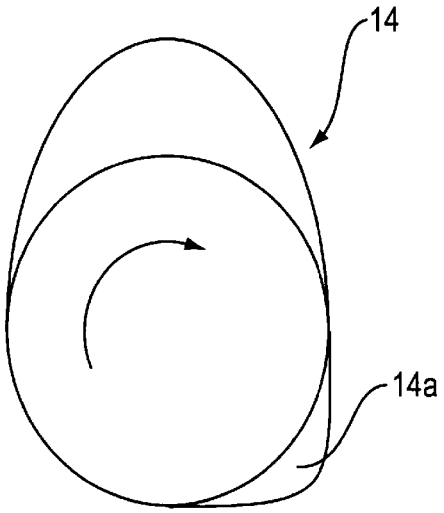
FIG. 6 is a diagrammatic front view of a cam of the engine according to the invention.

More specifically, with reference to the diagram of FIG. 5, which shows the quoted plane of an engine according to the invention, with engine rpms on the abscissas and the average effective pressure on ordinates, all the engine running points below a line f correspond to a condition in which only one of the two intake valves 7 of the engine is actuated. The other valve 7 is opened only at high speeds and high loads, i.e. at any point of area A above line f. Therefore, the area A corresponds to a condition of actuation of both the intake valves 7 associated with each engine cylinder. Whereas the area, designated by B, below line f, corresponds to actuation of only one of the two intake valves associated with each engine cylinder. As shown by the diagram 33 in FIG. 5, in area A, where it is necessary to obtain all the engine power, both intake valves are fully driven, in a way similar to a conventional engine. In area B, instead, one of the two intake salves 7 associated with each cylinder is closed, whereas the other valve is closed in advance, by providing a hydraulic uncoupling as described above. Naturally, the closing of the valve is more anticipated if the engine load is lower, in order to optimize the cylinder filling, as diagrammatically shown in diagrams 34, 35. Finally, in the part of area B arranged below a further line g, beyond anticipating the closing of the intake valve, the opening thereof is postponed, as diagrammatically shown in diagram 36.

Therefore, feeding of the air to the engine cylinders is only controlled by means of the two intake valves associated with each engine cylinder, only one of which is actuated at high loads and high speeds, to enable full power of the engine to be obtained, whereas the other valve is controlled gradually as a function of the engine running conditions, to optimize filling of the cylinder and combustion.

Figure 7:
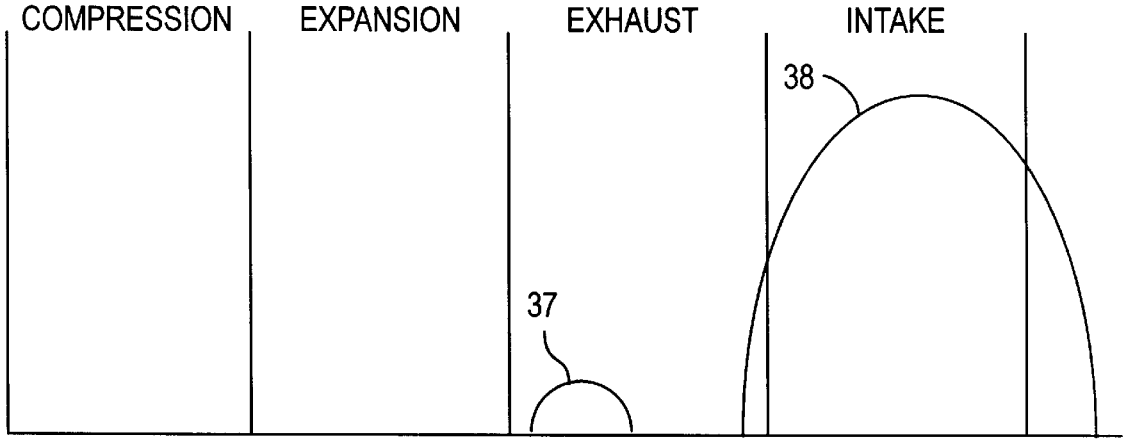
FIG. 7 is a diagram which shows the actuation of the intake and exhaust valves of the engine according to the invention.

As also indicated already above, cam 14 which controls the intake valve of each cylinder which is always actuated, has an auxiliary projection 14*a* which causes a partial opening of this valve during the discharge stage of the cylinder, so that a part of the residual combustion gases is directed by the piston which moves upwardly towards the top dead centre into the intake conduit, in order to obtain the advantages which have been clarified above. The diagram of FIG. 7 shows curves 37, 38 of the opening movement of the intake valve respectively during the cylinder discharge stage and intake stage.

As also clarified already, a further important feature of the invention lies in that the two intake conduits 4. 5 associated with each cylinder have different specific shapes directed to optimize the mixing of the air flows coming out therefrom within the combustion chamber. In particular, the intake conduit, which is controlled by the intake valve which is always activated, is shaped so as to generate a high tumble of the air flow coming out thereof within the combustion chamber. This can be obtained in any way known per se, by suitably designing the profile of the conduit.

Finally, the 90° arrangement of the tappet 16 with respect to the intake valve 7, enables this valve to be arranged substantially vertical, even if the axis 12 of cam shaft 11 is spaced horizontally apart from the cylinder axis. The vertical arrangement of the intake valve 7, enables the injector to be positioned in the best way within the intake conduit which is controlled by the intake valve which is always actuated, adjacent to the outlet of the conduit, so as to obtain optimum atomizing of the fuel within the combustion chamber, even if there is no vacuum in the ambient which is instead present in the conventional engines with throttle valve.

Figures 8, 9:
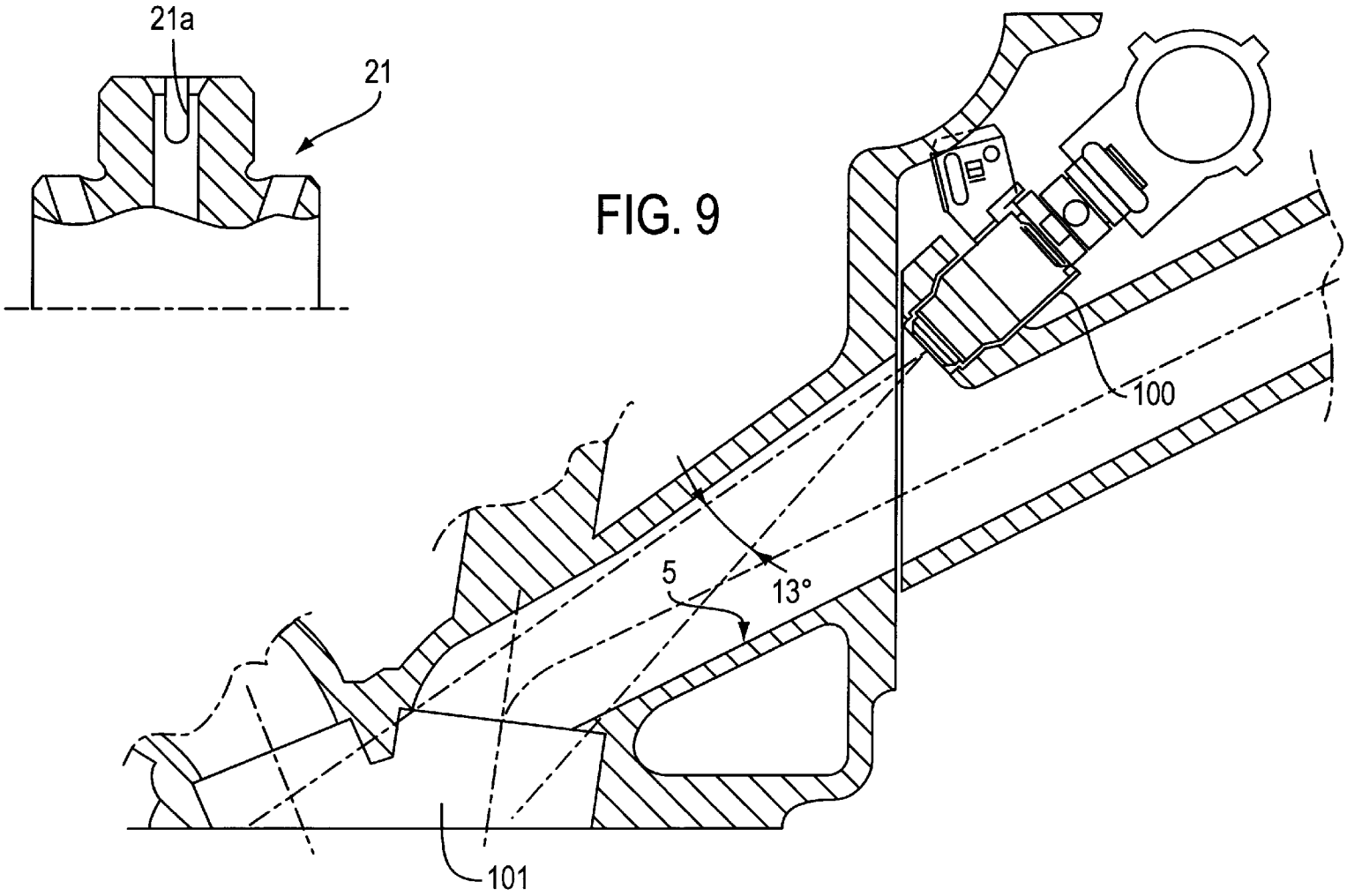
FIG. 8 is a cross-sectional view at an enlarged scale of a detail of FIG. 1.
FIG. 9 is a cross-sectional view which shows the arrangement of the injector.

FIG. 9 shows the arrangement of an injector 100 within the intake conduit 5, at a position sufficiently close to the outlet of conduit 5 opening into the combustion chamber 101, in order that the cone formed by the jet of injector 100 (which in the illustrated example is a 13° cone) reaches the combustion chamber 101 without being intercepted by the walls of conduit 5.

Naturally, while the principle of the invention remains the same, the details of construction and the embodiments may widely vary with respect to what as been described and illustrated without departing from the scope of the present invention.

What is claimed is:

1. multi-cylinder internal combustion engine, comprising:

at least one intake valve and at least one exhaust valve for each cylinder, each provided with respective spring means for biasing the valve to its closed position, in order to control respective intake conduits and exhaust conduits, a cam shaft for actuating the intake valves of the engine cylinders by means of respective tappets, wherein each of said tappets drives the respective intake valve against the action of said biasing spring means with the interposition of hydraulic means including a chamber of fluid under pressure, a solenoid valve for communicating said chamber of fluid under pressure to an outlet channel, in order to uncouple the tappet from the respective valve and cause the rapid closing of the latter under the action of the respective biasing spring means, electronic control means for said solenoid valve, in order to vary the opening timing and stroke of the intake valve as a function of at least one parameter of operation of the engine, characterized by the combination of the following features:

the engine is of the type comprising at least two intake valves for each cylinder, which control respective intake conduits, the engine has a fuel injection feeding system and lacks of a throttle valve arranged upstream of the engine intake manifold, the air flow fed to the engine cylinders being controlled only by the intake valves of the cylinders, the two intake valves associated with each engine cylinder are provided with two respective solenoid valves for controlling communication of the respective pressure chambers to said outlet channel, so that the two intake valves can be actuated in different ways and independently from each other, said electronic control means are able to open a first intake valve of each cylinder of the engine only above a pre-determined running condition of the engine, the second intake valve being the only valve to control the air flow fed to the cylinder below said running condition, the two intake conduits associated with each cylinder have specific shapes which are different and such as to favour the mixing of the air flows coming from the two intake conduits within the combustion chamber, wherein the tappet associated with each intake valve is arranged with its axis substantially at 90° with respect to the stem of the valve and in communication with the respective pressure chamber of said hydraulic means for pressurizing the fluid therein, and wherein a piston is slidably mounted in a cylinder disposed in axial alignment with said valve stem with one end of the piston in engagement with said valve stem and an opposite end of said piston in communication with said respective pressure chamber whereby upon movement of said tappet by said cam shaft, the fluid under pressure in said pressure chamber will cause movement of said valve to an open position.

2. Internal combustion engine according to claim 1, wherein to each engine cylinder there is associated a fuel injector, whose jet forms a cone with an amplitude not lower than 10°, said injector being arranged within the intake conduit controlled by said second intake valve, sufficiently close to the outlet of the conduit in order that the cone formed by the jet at the output of the injector be directed into the combustion chamber without substantially being intercepted by the conduit walls.

3. Internal combustion engine according to claim 1, wherein the cam actuating said second intake valve has an auxiliary projection for causing the partial opening of the intake valve during the discharge stage of the cylinder, in order to direct part of the residual combustion gases into the intake conduit controlled by said second intake valve.

4. Internal combustion engine according to claim 1, wherein said tappets associated with the intake valves of the engine with the respective hydraulic means for controlling the intake valves and the respective control solenoid valves, form part of a single pre-assembled sub-assembly fixed to the cylinder head.

5. Internal combustion engine according to claim 4, wherein said pre-assembled sub-assembly has a body including a conduit which communicates all the outlet channels controlled by the solenoid valves to at least one pressure accumulator, which also forms part of sub-assembly.

* * * * *